United States Patent [19]

Mitsui et al.

[11] 4,142,463

[45] Mar. 6, 1979

[54] PRINT CHARACTER SELECTION MECHANISM

[75] Inventors: Yoshihiro Mitsui; Tadayoshi Shimodaira, both of Shiojiri, Japan

[73] Assignee: Shinshu Seiki Kabushiki Kaisha and Kabushiki Kaisha Suwa Seikosha, Tokyo, Japan

[21] Appl. No.: 791,454

[22] Filed: Apr. 27, 1977

[30] Foreign Application Priority Data

Apr. 27, 1976 [JP] Japan ..... 51/53008[U]

[51] Int. Cl.[2] ..... B41J 1/30

[52] U.S. Cl. ..... 101/99; 101/95; 101/110

[58] Field of Search ..... 101/93.22, 95, 96, 99, 101/110

[56] References Cited

U.S. PATENT DOCUMENTS

| | | | |
|---|---|---|---|
| 3,756,147 | 9/1973 | Gross et al. | 101/95 |
| 3,821,672 | 6/1974 | Sturm | 101/99 X |
| 3,865,030 | 2/1975 | Chida et al. | 101/93.22 |
| 3,875,859 | 4/1975 | Busch | 101/99 |
| 3,878,779 | 4/1975 | Clary | 101/99 |
| 3,910,182 | 10/1975 | Wagner et al. | 101/110 |
| 4,033,256 | 7/1977 | Hanaoka | 101/95 X |

*Primary Examiner*—Edward M. Coven

*Attorney, Agent, or Firm*—Blum, Moscovitz, Friedman & Kaplan

[57] ABSTRACT

A print character selection mechanism for use with printers of the type wherein print characters are circumferentially disposed about the character ring and are selectively positioned in a print position by deenergizing an electromagnetic coil is provided. Each of the character rings includes a ratchet gear having a plurality of circumferentially disposed teeth, which teeth correspond to print characters circumferentially disposed about the print character ring. The instant invention is particularly characterized by a comb-shaped yoke member having a plurality of selection yokes, associated with each of the character rings, and a common yoke supporting each of the selection yokes. An electromagnetic coil is disposed about each selection yoke and is normally energized to induce a flux field in the selection yoke. A plurality of selection members are normally disposed in a rest position in abutting engagement with a selection yoke when the electromagnetic coil is energized. A resilient biasing member is disposed in engagement with each of the selection members for resiliently biasing each of the selector means into engagement with a ratchet wheel associated therewith to thereby select a print position of the character ring when the electromagnetic coil, associated with the selection yoke, is deenergized.

4 Claims, 10 Drawing Figures

PRINT CHARACTER SELECTION MECHANISM

BACKGROUND OF THE INVENTION

This invention is directed to a print character selection mechanism for printers of the type wherein print characters are selectively rotated into a print position and are selected by deenergizing an electromagnetic coil associated therewith, and in particular, to a print character selecting mechanism that substantially reduces the time required to effect positioning of a print character at a print position by reducing the time required to displace a selection member into engagement with the character rings after the electromagnetic coil is deenergized.

Heretofore, print character selection mechanisms for printers having a plurality of character rings, each character ring having print characters circumferentially disposed thereabout, have taken on various forms. In particular, print character selection mechanisms, wherein an electromagnetic actuating coil is formed about a displaceable yoke member, which yoke member in combination with a yoke member that is common to each of the other displaceable yoke mechanisms, define a closed magnetic flux field when the electromagnetic coil is energized and have been found to be less than completely satisfactory. Specifically, by utilizing a common yoke member for defining a closed magnetic flux path in each of the displaceable yoke members, if selection of a specific print character is effected by a deenergization of the electromagnetic coil, the magnetic flux fields induced in the adjacent character ring selection members are redirected by the common yoke in the same direction as the closed flux loop maintained by the electromagnetic coil, when the coil is energized, thereby delaying the selection of the print character until the redirected magnetic flux field, caused by the adjustment element, is overcome. The additional delay time, in addition to rendering the operation of the print character selecting mechanism less reliable, also requires that the time of the printing cycle be increased in order to take into account any additional unwanted magnetic flux fields caused by adjacent character ring selection members. Accordingly, a print character selection mechanism that eliminates the aforementioned disadvantage is desired.

SUMMARY OF THE INVENTION

Generally speaking, in accordance with the instant invention, a print character selection mechanism for a printer of the type including a plurality of character rings having print characters circumferentially disposed thereabout, is provided. Each of the print characters are selectively positioned in a print position by rotation of the character ring in a first rotational direction from a rest position. Each of the character rings is provided with a ratchet gear having a plurality of circumferentially disposed teeth, each tooth corresponding to a print character disposed on the print character ring. The instant invention is particularly characterized by a comb-shaped yoke member including a plurality of selection yokes associated with each of the character rings and a common yoke supporting each of the selection yokes. An electromagnetic coil is disposed about each selection yoke, the electromagnetic coils being normally energized to thereby induce a flux field in the selection yoke. A plurality of selection members are adapted to be maintained in a rest position, in abutting engagement with a selection yoke, when the electromagnetic coil surrounding the selection yoke is energized. The selection members are adapted to be displaced from a rest position to an engaging position in engagement with a ratchet wheel associated therewith to thereby define a print position of the character ring. A resilient biasing element is disposed in engagement with each of the selection members to effect resilient biasing of the respective selective members into an engaging position in response to the deenergization of an electromagnetic coil surrounding the selection yoke against which the selection member is disposed in abutting engagement.

Further reductions in the time required to complete a print cycle are effected by a selection member return mechanism that applies pressure against the resilient biasing member to thereby return the selection members to a rest position and/or by increasing the impedance disposed in parallel with the electromagnetic coil in the demagnetizing circuitry utilized with the electromagnetic coils.

Accordingly, it is an object of the instant invention to provide an improved print character selection mechanism for a printer of the type having a plurality of character rings having print characters circumferentially disposed thereabout.

Another object of the instant invention is to provide an improved print character selection mechanism wherein destabilizing affects of adjacent magnetic flux fields are substantially reduced.

Still another object of the instant invention is to provide an improved print character selection mechanism for a printer of the type wherein selection of a print position is effected by deenergizing an electromagnetic coil wherein the time required to release the print character selection members is substantially reduced.

Still a further object of the instant invention is to provide a print character selection mechanism wherein an improved comb-like yoke configuration and resilient biasing member is utilized to substantially reduce the time required to effect a print cycle.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1A:
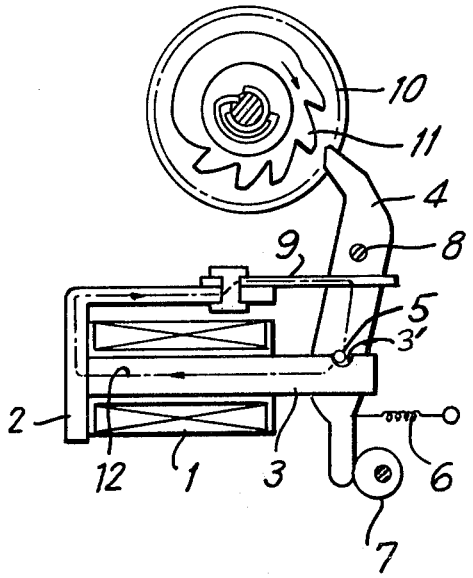
FIG. 1a PRIOR ART
FIG. 1*a* is an elevational view of a print character selection mechanism for a printer constructed in accordance with the prior art.
Figure 1B:
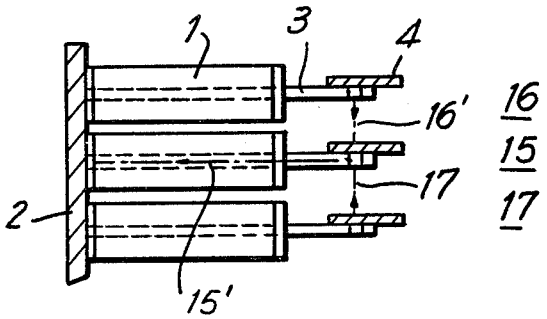
FIG. 1b PRIOR ART
FIG. 1*b* is a sectional view of the print character selection mechanism depicted in FIG. 1*a;*

Reference is now made to FIGS. 1*a* and 1*b*, wherein a print character selection mechanism for a printer is depicted. The printer includes a plurality of character rings 10 having print characters circumferentially disposed thereabout. Each character ring 10 includes a ratchet gear 11, either coupled thereto or integrally formed therewith, the teeth of the ratchet gear 11 corresponding to a specific print character disposed on the print character ring in a conventional manner. Specifically, at the beginning of each print cycle, a shaft rotatably supporting each of the character rings is rotated in a clockwise direction until a selection pawl 4 is disposed in engagement with one of the teeth of a ratchet wheel, thereby preventing the particular character ring, associated with the ratchet wheel, from being further rotated and, hence, defining a print position for the character ring 10. After each of the character rings are positioned, and printing is effected, the print cycle is completed by permitting each of the character rings to be rotated in the opposite rotational direction by a suitable biasing spring to thereby return each of the character rings to a rest position. Simultaneously with the return of the character rings from a print position to a rest position, suitable means are provided for disengaging the selection pawl from the ratchet gears and returning same to a rest position. It is noted that the instant invention is directed to a print character selection mechanism particularly utilized with printers having a plurality of character rings of the type detailed above, which character ring printers are well known in the art, and accordingly, with the exception of the manner in which the elements of the print character selecting mechanism character ring arrangements interrelate with the elements of the print character selection mechanism, the character ring arrangement is, in no way, deemed to be within the scope of the instant invention and is presented herein for purposes of explanation only.

Print character selection mechanisms, constructed in accordance with the prior art, include a selection pawl 4, which pawl is pivotally mounted about a pivot 8 and includes a support pin 5, which pin is disposed in a notch 3' in a moveable actuator yoke 3, in order to assure that the pawl is positioned out of engagement with the ratchet wheel 11 when the moveable yoke 3 is disposed in the position depicted in FIG. 1*a*. A resilient spring 6 is coupled to selection pawl 4 in order to resiliently bias same in a clockwise direction about pivot pin 8. Surrounding each moveable actuator yoke 3 is an electromagnetic coil 1, which coil is normally energized in order to effect a positioning of the selection pawl 4 out of engagement with the ratchet wheel 11. A single yoke 2 is disposed in common with each of the moveable actuator yokes 3 in order to define respective closed loop flux fields 12 in the common yoke 2, selection pawl 4 and moveable actuator yoke 3 when the electromagnetic coil 1 is energized.

In order to selectively position the character ring 10, in a predetermined print position, the character ring is rotated until the selection pawl 4 is pivoted into engagement with the ratchet wheel 11 to thereby prevent the character ring from rotating and thereby fixing the print character disposed on the character ring in a print position. Pivoting of the selection pawl 4 into an engaged position with the ratchet wheel is effected by preventing a current from being applied to the electromagnetic coil 1. Specifically, when the electromagnetic coil is deenergized by cutting-off the current flow therethrough, the magnetic field between the yoke 2 and moveable actuator yoke 3 is substantially reduced, thereby permitting the moveable actuator yoke 3 and selection pawl 4 to be pivoted in a clockwise rotation about pivot pin 8 by resilient spring 6. After printing is effected, an accentric cam 7 is rotated into engagement with each of the selection pawls 4 and effects a pivoting of the selection pawls 4 in a clockwise direction about pivot pin 8 to thereby bring the moveable actuator yoke 3 into abutting engagement with yoke 2. Accordingly, if the electromagnetic coil 1 is once again energized at the time that the moveable actuator yoke 3 is disposed in engagement or proximate to an engagement position with the yoke 2, the closed magnetic flux field 12 will once again be defined and thereby retain the moveable actuator yoke 3 at the rest position illustrated in FIG. 1*a*. Thereafter, eccentric cam 7 is further rotated out of abutting engagement with the selection pawl 4 to thereby return the print character selecting mechanism to a rest position.

As is particularly illustrated in FIG. 1*b*, when a character ring, designated as 15, disposed between two adjacent character rings, designated as 16 and 17, is to be engaged by a selection pawl, deenergization of the electromagnetic coil, associated with the character ring 15, will result in the magnetic flux fields 16' and 17' from the adjacent selection members defining a secondary flux field in the moveable actuation yoke 3. Specifically, the selection members associated with character rings 16 and 17 continue to have a flux field applied thereto by the energization of the electromagnetic coils associated therewith. Nevertheless, flux fields 16' and 17' are redirected through the upper portion of the common yoke 2 to define a secondary magnetic flux field 15' in the same direction as the closed loop flux field 12, thereby maintaining the moveable actuator yoke 3 at a rest position. At the least, the secondary flux field 15', in the yoke 3, will delay the time required for the resilient spring 6 to overcome the attractive force between the moveable actuator yoke 3 and common yoke 2 and, hence, delay the time required to effect pivoting of the selector pawl 4. Moveover, if the secondary magnetic flux field 15' is of sufficient magnitude, selection of the wrong print character, or in the worst case, the absolute failure of the moveable actuator yoke to be released and, hence, result in no selection of a print character during the printing cycle can occur. Although the use of heavy duty spring 6 for increasing the resilient bias on the selection pawl have been attempted, the increased resilient biasing force has been found to be less than completely satisfactory since it is likely to overcome the attractive force between the common yoke 2 and moveable actuator yoke 3 when oscillations are induced in the electromagnetic coil 1. If the current applied to electromagnetic coil 1 is increased, in order to reduce the likelihood of oscillation causing an inadvertent release of the moveable actuator arm, the increased current will once again increase the time required for the resilient spring to overcome the attracting force between the moveable actuator yoke 3 and common yoke 2 and, hence, eliminate any of the benefits that would have obtained by utilizing a more resilient spring.

It is noted therefore that the time required to overcome the secondary magnetic flux field 15', in the moveable actuator yoke 3, when the electromagnetic coil surrounding same is deenergized, must be taken into account in determining each print cycle, thereby considerably reducing the printing speed of the printer. Moreover, it is further noted that a moveable actuator yoke 3 must be returned into engagement with the common yoke 2 at the completion of each printing cycle. It is therefore necessary to increase the magnetic flux fields induced in the moveable actuator yoke to take into account the air gap between the moveable yoke and common yoke when the moveable yoke is returned to a rest position in order to assure that same is returned into engagement with the common yoke. This increase in the flux fields results in a corresponding increase in the time required to effect a release of the adjacent moveable actuator yokes. Finally, the clearance between the pin 5, that results from the two part construction thereof, creates an inertia that must be overcome in order to effect each displacement of the selection pawl 4 and, as a consequence thereof, an additional delay in effecting a displacement of the selection pawl into an engaged position with the ratchet wheel 11.

In light of the foregoing, it is apparent that when the current flow in the electromagnetic coils is terminated, the attractive magnetic force between the common yoke 2 and moveable actuator yoke 3 is slowly attenuated, thereby delaying the actual release of the moveable actuator yoke and, hence, providing a likewise decrease in the printing speed obtained by the printer. It is noted that a demagnetizing circuit, including a diode coupled in parallel with the electromagnetic coil, can be utilized to increase the attenuation of the attractive forces when the electromagnetic coil is deenergized.

Figure 2:
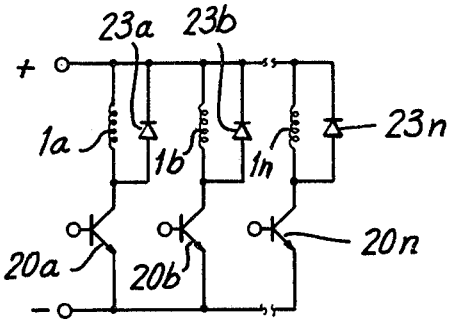
FIG. 2 PRIOR ART
FIG. 2 is a circuit diagram of a demagnetizing circuit constructed in accordance with the prior art.

Referring specifically to FIG. 2, a demagnetizing circuit of the type utilized to control the deenergizing of the electromagnetic coils in a print character selection mechanism, constructed in accordance with the prior art, is depicted. Specifically, the collector-emitter current path of each control transistor 20*a* through 20*n* is coupled in series to a parallel connection of an electromagnetic coil 1*a* through 1*c* and an attenuating diode 23*a* through 23*n*. A specific function of the diodes 23*a* and 23*n* is to effect additional consumption of the electromagnetic energy induced by the electromagnetic coil when the control transistors are turned OFF, thereby preventing current flow through the particular electromagnetic coil coupled to the control transistor.

Figure 3:
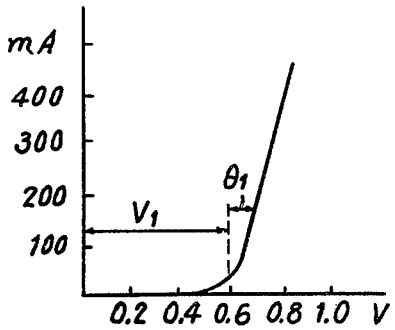
FIG. 3 PRIOR ART
FIG. 3 is a current-voltage voltage characteristic of the diodes disposed in the demagnetizing circuit depicted in FIG. 2.

The forward voltage-forward current characteristic of the diodes 23*a* through 23*n* is illustrated in FIG. 3, the abscissa representing the forward voltage and the ordinate representing the forward current. Accordingly, as illustrated in FIG. 3, the diode has a saturating voltage $V_1$ on the order of 0.6V and a resistance $R_2$ determined by tan $\theta$. Accordingly, the impedance characteristic at room temperature for a silicon diode is on the order of $(0.8-0.6)/0.4 = 0.5\Omega$.

Figure 4:
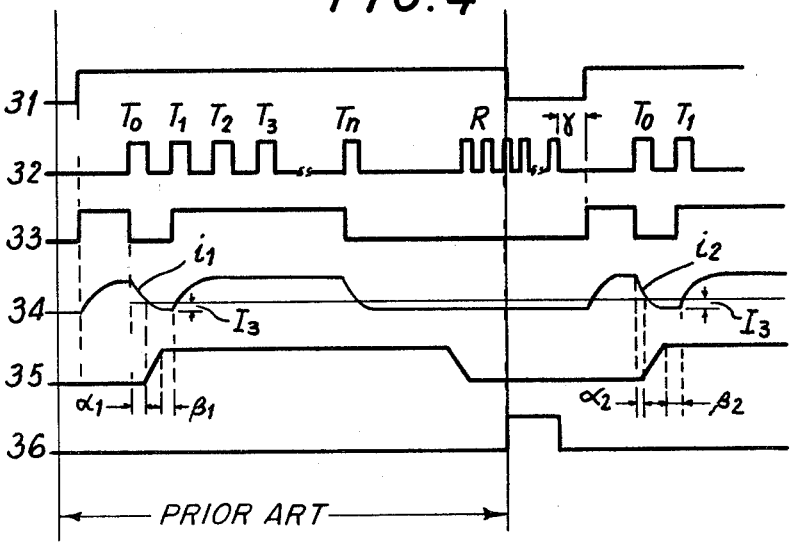
FIG. 4 is a comparative timing diagram illustrating the operation of the print character selection mechanisms depicted in FIG. 1*a* and FIGS. 6*a* and 7.

When the print character selection mechanism, depicted in FIGS. 1*a* and 1*b*, is utilized with the demagnetizing circuit, depicted in FIG. 2, the length of the print cycle is illustrated on the left half portion of the timing diagram, illustrated in FIG. 4. In FIG. 4, signal 31 is a pulse applied to effect a printing cycle by effecting rotation of the character rings. The pulse signal 32 represents the specific print character selection pulses produced during the print cycle. Pulse signal 33 represents the current signal applied to the electromagnetic coil 1. Pulse signal 34 represents the current flowing through the electromagnetic coil 1. Pulse signal 35 illustrates the manner in which the selection pawl 4 is controlled by the print character selection mechanism, and, finally, pulse signal 36 represents the print-off signal utilized to terminate the signal 31 utilized to commence the print cycle and thereby effect an end to the print cycle. Accordingly, each printing cycle is completed at a time $\alpha$, after the falling edge of the print cycle pulse signal 36, and return pulses R are generated, thereby permitting the character rings to be returned in an opposite rotational direction to a rest position.

Figure 5:
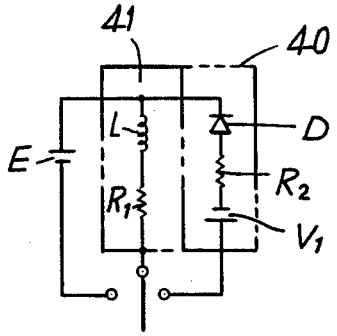
FIG. 5 PRIOR ART
FIG. 5 is an equivalent circuit diagram of the demagnetizing circuit depicted in FIG. 2.

The diodes 23*a* through 23*n* determine the characteristic of the current flow through the electromagnetic coils 1*a* through 1*n*. Specifically, in FIG. 5, an equivalent demagnetizing circuit is represented by circuits 40 and 41. Equivalent circuit 40 includes an ideal diode D, a resistor $R_2$ and a battery $V_1$. When the control transistors are turned OFF, thereby preventing a current flow in the electromagnetic coils, the equivalent circuit 40 defines a closed loop circuit with the equivalent circuit 41, respresented by the resistor $R_1$ and inductor coil L, coupled in series. Accordingly, the closed loop circuit determines the speed at which the electromagnetic energy, stored in the inductor coil L, is attenuated. Empirically, the electric current $i_1$, at the moment that current flow through the coil is cut off, is $i_1 = E/R_1(\epsilon - t/\tau_1)$, wherein the time constant $\tau_1 = L/R_1$, which time constant is a well known time constant for a RL series loop. Accordingly, if the current level, at which the moveable actuator yoke can overcome the attractive forces between same and the common yoke 2, is defined as $I_3$, the actual delay from the time that the current flow in the electromagnetic coil is cut off till the selection pawl 4 begins to be displaced to an engaging position is $\alpha_1$. Moreover, as illustrated by pulse signal 35, $\beta_1$ represents the time at which the selection pawl 4 is completely disposed in an engaging position with the ratchet wheel so that the next print character pulse $T_1$ can be applied to select a further print character. Because the resistance $R_2$, defined by the diode, is small when compared with the resistance $R_1$ of the inductor coil, for all intents and purposes, the time constant of the current in the electromagnetic coil 1 is determined by the resistance $R_1$ of the electromagnetic coil, and accordingly, resistance of the diode does not sufficiently contribute to the increase in the speed at which the current levels are attenuated in the electromagnetic coil to thereby reduce the attractive forces between the common yoke 2 and moveable actuatable yoke 3.

Accordingly, the instant invention is particularly characterized by a print character selection mechanism for increasing the speed at which a selection pawl is displaced into engagement with a ratchet wheel once the electromagnetic coil is deenergized. In a further embodiment, demagnetizing circuitry for further increasing the speed with which the current, in the electromagnetic coil is attenuated, is provided.

Figure 6B:
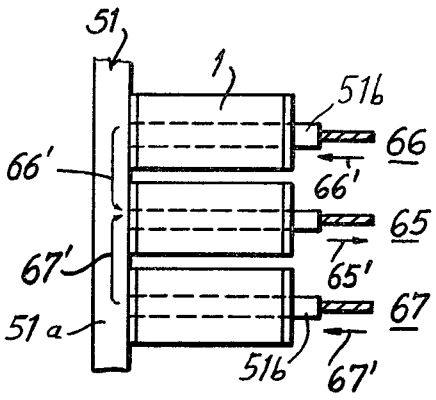
FIG. 6*b* is a partial sectional view of the print character selection mechanism depicted in FIG. 6*a;*
Figure 6A:
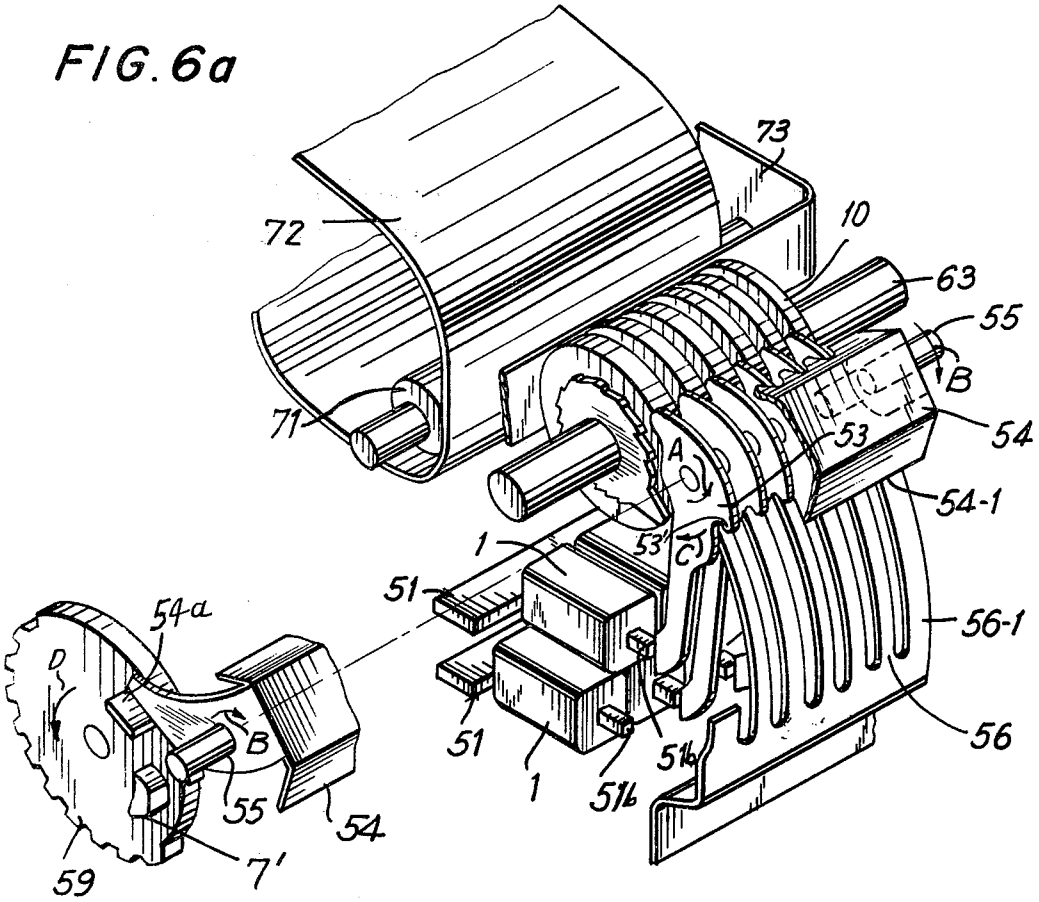
FIG. 6*a* is an exploded perspective view of a print character selection mechanism for a printer constructed in accordance with a preferred embodiment of the instant invention.

Reference is now made to FIGS. 6*a* and 6*b*, wherein a print character selecting mechanism, constructed in accordance with the instant invention, is depicted, like reference numerals being utilized to denote like elements described above. The print character selecting mechanism is particularly characterized by a comb-shaped iron core 51, having a common yoke portion 51*a* and selection yokes 51*b*. The selection yokes 51*b* have electromagnetic coils 1 disposed thereabout. Selection members 53 are pivotally disposed about shaft 55 so that each of the selection members 53 are disposed in abutting engagement with the selection yoke 51*b* when the electromagnetic coils 1 are energized. To this end, it is necessary to form the selection members 53 from a magnetic permeable material in order to insure that same are magnetically attracted to the respective selection cores 51*a* to which same are disposed in abutting engagement when the electromagnetic coils 1 are energized. A flat spring element 56, having resilient prongs 56-1 respectively disposed in engagement with the projecting portions 53' on each of the selection elements 53, effects a constant application of a resilient biasing force in the direction illustrated by the arrow A in FIG. 6*a*. Accordingly, in the absence of a magnetic flux field affecting an attractive force between the selection elements 53 and the selection yokes 51*b*, associated therewith, the resilient prongs 56-1 effect a rotatable displacement of the selection elements 53 about shaft 55 into engagement with ratchet wheels 11, in order to obtain a positioning of the character rings at a print position in the manner detailed above with respect to the prior art.

In order to effect a return of the print hammers from a position in which same engage the ratchet wheel 11 to a rest position in abutting engagement with selection yokes 51*b*, a return member 54 is rotatably mounted on a shaft 55 and includes a projecting surface 54*a* extending therefrom. In place of the eccentric cam 7, utilized in the prior art, a cam 7' is disposed on a gear 59, which gear is rotated one revolution for each print cycle of the printer. Accordingly, once the printing is completed by the printer, the cam 7' is rotated into engagement with the projecting surface 54*a* of the return member to thereby rotate the return member 54 in the direction of the arrow B, thereby causing the lower wall 54-1 of the return member 54 to be disposed in engagement with the resilient prong 56-1 and thereby apply a pressure to the resilient prongs so that the prongs, in turn, apply a biasing force against the selection members 53 in the direction of the arrow C, thereby effecting a pivotable displacement of the selection members from an engaging position to a rest position wherein the selection members are disposed in abutting engagement with the selection yokes associated therewith. By utilizing the return member to bias the resilient prongs into engagement with the selection members, and thereby force the selection members into abutting engagement with the electromagnetic coil 1, the likelihood of a gap remaining between the selection yokes and the selection members is substantially reduced, thereby assuring that a proper attractive force between the selection yokes and selection members is obtained utilizing a minimum of current, and thereby ultimately lessening the release time of the selection members when same are released during the print cycle.

The print character selecting operation is effected by the selecting mechanism in the following manner. The character rings 10 are initially rotated by a drive shaft 63, the drive shaft being driven during the positive cycle of the pulse signal 31. A spring (of the type illustrated in FIG. 1) is adapted to return each of the character rings to a rest position once the pulse signal ceases to be applied and ceases to effect rotation of drive shaft 63. Rotary gear 59 is rotated in the direction of the arrow D so that the cam 7' engages the camming surface 54*a* of the return member 54, in the manner detailed above, so that the selection members 53 are returned by the lower wall 54-1 of the return member in the manner discussed above. During the print cycle, selection of a print position is effected by disposing the selection members 53 in engagement with the ratchet gears 11 to thereby define a print position of the character ring. Specifically, as each character ring reaches a position whereby the print character disposed thereabout is in a printing position, the electromangetic coil, wrapped about the selection yoke associated with the particular character ring, is deenergized, thereby permitting the resilient prongs 56-1 to pivot the selection members 53 in the direction indicated by the arrow A into engagement with the ratchet gear 11. Once each of the character rings 10 has been fixedly positioned in a print position by engagement of the ratchet wheels by the selection members 53, printing is effected by the printer in a well known manner. By way of explanation, a platen 71 is provided for disposing a web of printing paper 72 and an ink ribbon 73 in pressure contact with the print character to effect printing in a well known manner.

Once printing of the line of print, provided by the positioning of each of the print characters at a print position, is completed, the cam 7' on gear 59 is brought into engagement with projecting surface 54*a* of return member 54, in the manner detailed above, to thereby bring the return member into engagement with each of the spring prongs 56-1 and thereby cause a return of each of the selection members 53 into abutting engagement with the selection yokes 51*b*. It is noted that, at the same time that the cam 7' engages the return member 54, to effect a return of each of the selection members, the electromagnetic coils are energized to thereby maintain the selection members at a rest position. Additionally, the current pulse signal 31 is no longer applied to the main gear mechanism that effects control of the shaft 63, thereby permitting each of the character rings to be returned in the opposite rotational direction so that the character rings are returned to a rest position at a time $\alpha$ after the final character selection pulse R, of the character selecting pulse signal 32, is detected. The print cycle is therefore completed at the time $\alpha$ after the final character return pulse R is detected.

Accordingly, the magnetic circuit utilized to control the selection members 53 is comprised of a comb-shaped core, including common yoke 51*a* and a plurality of selection yokes 51*b* projecting therefrom. As is particularly illustrated in FIG. 6*b*, by eliminating the moveable actuatable yoke present in the prior art print character selection mechanisms, when a first print character, designated as 65, is adapted to be released and is disposed between adjacent print characters, designated as 66 and 67, the flux fields 66' and 67' in the adjacent selection yokes are oriented in the direction 65', which direction thereby provides the magnetic flux field in the selection yoke 51*b* that is of opposite polarity to that utilized to attract the selection member 53. Accordingly, the flux field 66' and 67' induced in the selection yoke, when the electromagnetic coil associated with print character 65 is deenergized, act to weaken the attractive forces between the selection yoke **51*b* and the selection member 53** and thereby substantially eliminate any delay in releasing the selection member from its rest position in abutting engagement with the selection yoke. The instant invention is particularly characterized by providing the comb-shaped core construction and selection member construction wherein the magnetic fields from adjacent print character selection members act to substantially reduce the magnetic field in response to a deenergization of the electromagnetic coil when a print character selection is to be effected.

Figure 7:
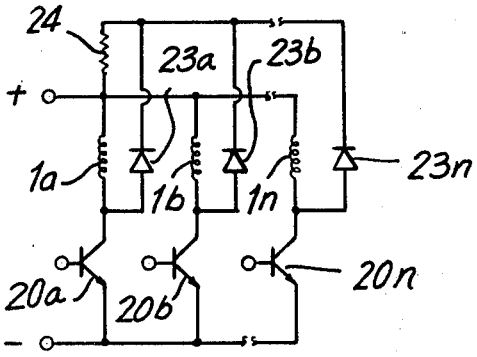
FIG. 7 is a circuit diagram of a demagnetizing circuit constructed in accordance with a preferred embodiment of the instant invention.

Reference is now made to FIG. 7 wherein an improved demagnetizing circuit for use with the character selecting mechanism, depicted in FIGS. **6*a* and 6*b*, is illustrated, like reference numerals being utilized to denote like elements depicted above. It is noted that a resistor 24 is disposed in series with the diodes 23*a* through 23*n* in order to accelerate attenuation of the current levels in the electromagnetic coils 1*a* through 1*n* when current flow therethough is cut off. Specifically, the current $i_2$, illustrated by the right half of the wave diagram in FIG. 4, is rapidly attenuated since the time constant $\tau_2=[L/R_1+R_2+R_4)]$, where $R_4$ equals the resistance of the resistor 24, illustrated in FIG. 7. By adding the resistance $R_4$, the elapsed time required to attenuate the current in the electromagnetic coils, once current flow therethough is cut off, is reduced to $\alpha_2$, thereby increasing the time before the next character pulse can be applied to effect selection of a further character ring to $\beta_2$, which time interval is considerably larger than $\beta_1$, illustrated on the left-hand side of FIG. 4. Alternatively, the elapsed time $\beta_1$, between applying character select pulses can be utilized in order to increase the printing speed by increasing the rotational speed of the print character rings 10** and shortening the intervals to $\beta_1$ between the application of each of the character selection pulses.

Figure 8:
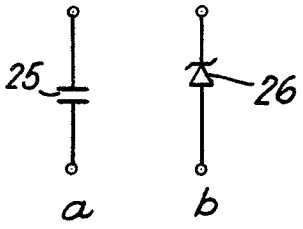
FIG. 8 illustrates two examples of impedance elements suitable for use in the demagnetizing circuit depicted in FIG. 7.

It is noted that the value of the resistor $R_4$ is selected to be several times larger than the equivalent resistance $R_2$ (0.5 ohms) of the diode, thereby rendering the time constant $\tau_2$, of the electromagnetic coils, substantially equal to $[L/(R_1+R_4)]$, and thereby substantially reducing the delay time $\alpha_2$. In addition to disposing a high magnitude resistance in series with the diodes **23*a* through 23*n*, as is illustrated in FIG. 8, other high impedance elements can be disposed in series with the attenuating diodes. As is illustrated in FIG. 8, a first alternative a is the use of a capacitor 25, whereas a second alternative b is the use of a Zener diode 26, both the Zener diode and capacitor providing a sufficiently high impedance to effect the increased attenuation levels described above with respect to the resistor 24. Moreover, the impedance of the resistor 24** can be adjusted to accommodate a particular desired printing speed, the exact magnitude of the impedance being selected by the skilled artisan.

Accordingly, the instant invention is particularly characterized by an improved print character selection mechanism that substantially reduces the delay in effecting a release of a selection member when the electromagentic coil, utilized to actuate the selection member, is deenergized. Additionally, improved demagnetizing circuitry can be provided to accelerate the attenuation of the current levels in the electromagnetic coil to thereby reduce the delays caused by the residual current levels retained in the electromagnetic coils once the current flow therein is cut off.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In a printer including a plurality of character rings having print characters circumferentially disposed thereabout, said print characters being selectively positioned in a print position by rotation of said character rings in a first rotational direction from a rest position, each of said character rings having a ratchet gear coupled thereto, each of said ratchet gears having a plurality of circumferentially disposed teeth, each of said teeth corresponding to a print character disposed on said print character ring, the improvement comprising a core member including a plurality of selection portions, each selection portion being associated with a character ring and a common portion supporting each of said selection portions, an electromagnetic coil disposed about each said selection portion, each of said electromagnetic coils being normally energized to induce a flux field in said selection portion about which said coil is disposed, each said electromagnetic coil being further adapted to be selectively deenergized, a plurality of selection members, each selection member being associated with a selection portion and each selection member being adapted to be maintained in a rest position in abutting engagement with said selection portion associated therewith when the electromagnetic coil disposed thereabout is energized, each said selection member being mounted to be displaced from said rest position to an energizing position in engagement with a ratchet wheel associated therewith to thereby define a print position of said character ring, and a resilient biasing means disposed in engagement with each of said selection members and a demagnetizing circuit means coupled in parallel with each of said coils for reducing the attenuation level in said coils when same are deenergized, said demagnetizing circuit means including diode attentuation means series-coupled to an impedance means having a high impedance when compared to said diode means.

2. A printer as claimed in claim 1, and including a return means for returning each of said selection members to said rest position, said return means being adapted to be displaced into engagement with said resilient biasing means to thereby impart into said resilient biasing means a force sufficient to overcome the resilient bias imparted thereby, and further cause said resilient biasing means to return each of said selection members to said rest position.

3. A printer as claimed in claim 2, and a rotatable shaft each of said selection members being disposed on said rotatable shaft to pivot thereabout, so that the selection members are coordinately pivotably displaceable between said rest position and engaging position, said return means being pivotably supported on said rotatable shaft, but out of engagement with said selection members.

4. A printer as claimed in claim 3, and including camming means adapted to be rotated through a complete cycle for each print cycle of a printer, said return means including a camming surface, said camming surface being adapted to be engaged by said camming means at the end of each print cycle to thereby effect a pivoting of said return means into engagement with said resilient biasing means to thereby force said resilient biasing means into engagement with each of the selection members and thereby apply a pivoting force to each of the selection members to effect a pivoting thereof to said rest position.

* * * * *